US008274204B2

(12) United States Patent
Ma

(10) Patent No.: US 8,274,204 B2
(45) Date of Patent: Sep. 25, 2012

(54) SPARK PLUG WITH PLATINUM-BASED ELECTRODE MATERIAL

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 37 days.

(21) Appl. No.: 12/954,262

(22) Filed: Nov. 24, 2010

(65) Prior Publication Data

US 2011/0121713 A1 May 26, 2011

Related U.S. Application Data

(60) Provisional application No. 61/264,074, filed on Nov. 24, 2009.

(51) Int. Cl.
*H01T 13/39* (2006.01)

(52) U.S. Cl. ..... 313/141; 123/169 EL

(58) Field of Classification Search ..... 313/141; 123/169 EL

See application file for complete search history.

(56) References Cited

U.S. PATENT DOCUMENTS

| | | | | |
|---|---|---|---|---|
| 5,275,670 | A | 1/1994 | Smialek et al. | |
| 2001/0013746 | A1 | 8/2001 | Kanao et al. | |
| 2006/0163992 | A1 * | 7/2006 | Kanao et al. | 313/141 |
| 2007/0236123 | A1 | 10/2007 | Lykowski et al. | |
| 2007/0236125 | A1 | 10/2007 | Lykowski et al. | |

OTHER PUBLICATIONS

Jochen Rager, Alexr Flaig, Gerhard Schneider, Thomas Kaiser, Flavio Soldera, Frank Mücklich, "Oxidation Damage of Spark Plug Electrodes". Advanced Engineering Materials, vol. 7, No. 7, 2005, pp. 633-640.

Hironori Osamura, Nobuo Abe, Denso Corporation. "Development of New Iridium Alloy for Spark Plug Electrodes". Society of Automotive Engineers, 2009, 15 pages.

F.A. Soldera, Frank Mücklich. On the Erosion of Materials Surface Caused by Electrical Plasma Discharging. Mater. Res. Soc. Symp. vol. 843, 2005, pp. 177-182.

P.J. Hill, T.Biggs, P.Ellis, J.Hohls, S.Taylor, I.M.Wolff. "An Assessment of Ternary Precipitation strengthened PT Alloys for Ultra-high Temperature Applications". Materials Science and Engineering A301 (2001) pp. 167-179.

R.N. Mahaptara, S.K. Varma, C.S. Lei. "Thermal Stability and Oxidation Resistance of PT-10A1-4Cr Alloy at Super High Temperature". Oxidation of Metals, vol. 66, Oct. 2006, pp. 127-135.

T.Massalski, in: T.B.Massalski (ed), Binary Alloy Phase Diagram, vol. 1, ASM, Metals Park, OH, 1986, p. 153.

P.J.Hill, L.A.Cornish, P.Ellis, M.J.Witcomb. "The Effects of Ti and Cr Addition on the Phase Equilibria and Properties of PT/PT3A1 Alloys". Journal of Alloys and Compounds 322 (2001) pp. 166-175.

International Search Report for PCT/US2010/058054, Aug. 31, 2011, 5 pages.

* cited by examiner

*Primary Examiner* — Karabi Guharay
(74) *Attorney, Agent, or Firm* — Reising Ethington P.C.

(57) ABSTRACT

A spark plug for an internal combustion engine has one or more electrodes with an electrode material of a platinum (Pt) based alloy. The alloy includes aluminum (Al) and one or more refractory metals selected from the group containing nickel (Ni), rhenium (Re), ruthenium (Ru), tantalum (Ta), molybdenum (Mo), and tungsten (W). In at least some of the disclosed alloys, the aluminum contributes to the formation of an aluminum oxide ($Al_2O_3$) layer on a surface of the electrode material.

19 Claims, 2 Drawing Sheets

SPARK PLUG WITH PLATINUM-BASED ELECTRODE MATERIAL

CROSS-REFERENCE TO RELATED APPLICATION

This application claims the benefit of U.S. Provisional Ser. No. 61/264,074 filed Nov. 24, 2009, the entire contents of which are herein incorporated by reference.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug that comprises a metallic shell, an insulator, a center electrode and a ground electrode. The center electrode, the ground electrode or both includes an electrode material having about 50 to 99 atomic % of platinum (Pt), having about 5 to 20 atomic % of aluminum (Al), and having no more than about 30 atomic % of a refractory metal that is selected from the group consisting of nickel (Ni), rhenium (Re), ruthenium (Ru), tantalum (Ta), tungsten (W), molybdenum (Mo), or a combination thereof.

According to another embodiment, there is provided a spark plug electrode that comprises an electrode material having about 50 to 99 atomic % of platinum (Pt), having about 5 to 20 atomic % of aluminum (Al), and having no more than about 30 atomic % of a refractory metal that is selected from the group consisting of nickel (Ni), rhenium (Re), ruthenium (Ru), tantalum (Ta), tungsten (W), molybdenum (Mo), or a combination thereof.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in FIGS. 1-5 and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 1:
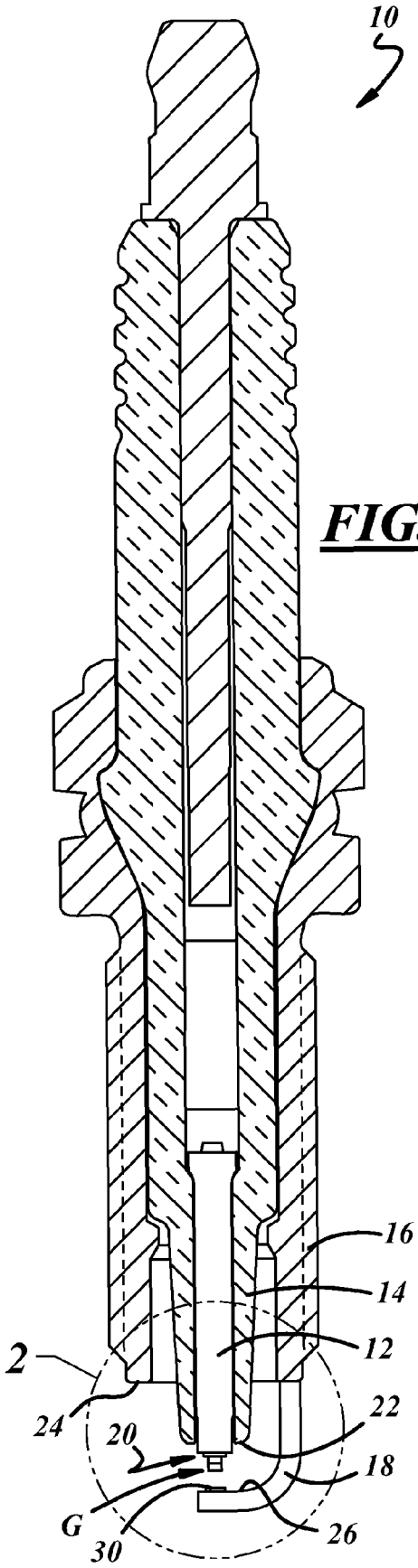
FIG. 1 is a cross-sectional view of an exemplary spark plug that may use the electrode material described below.
Figure 2:
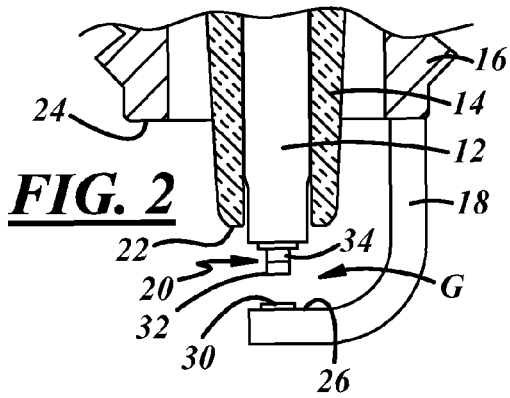
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
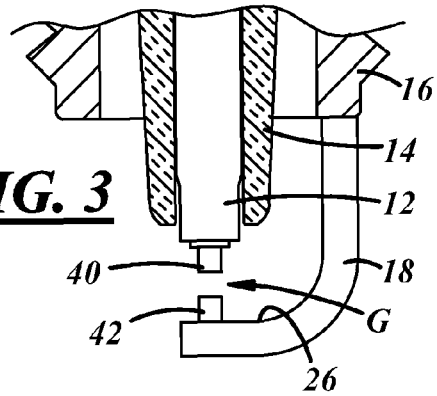
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
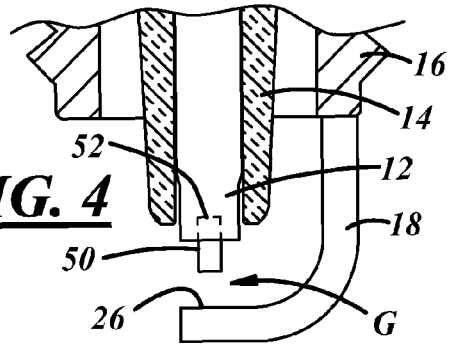
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
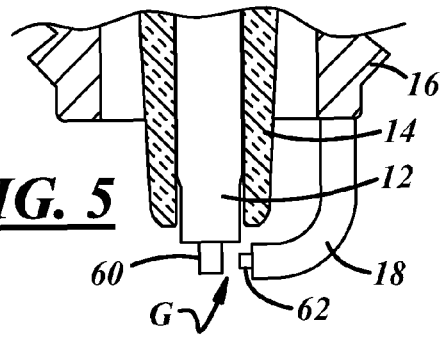
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from the side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and the side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
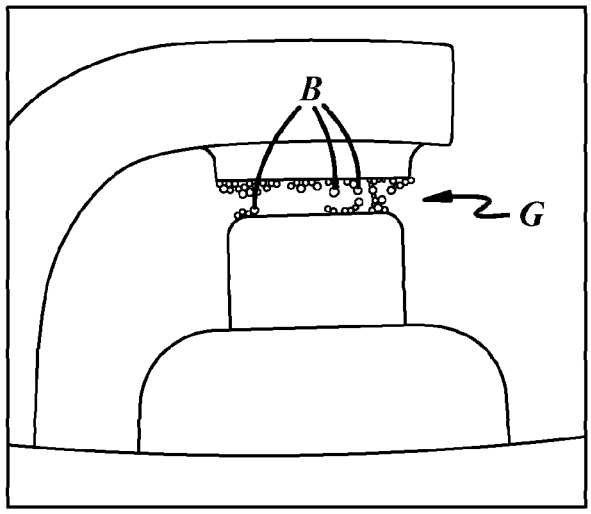
FIG. 6 is schematic representation of a so-called balling and bridging phenomenon at the electrodes of an exemplary spark plug that does not use the electrode material described below.
Figure 7:
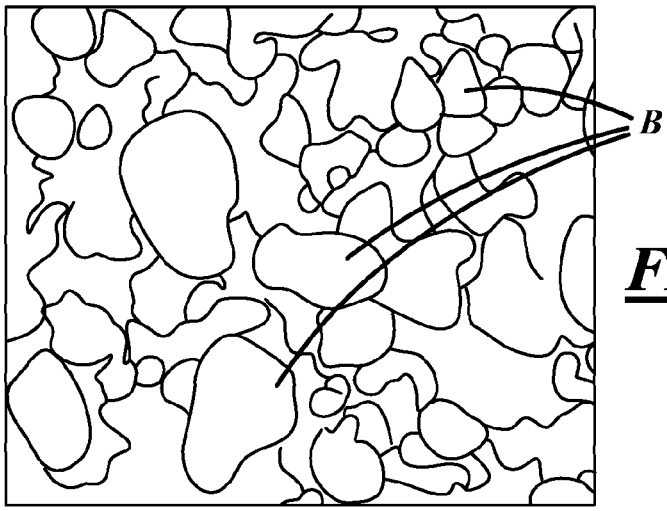
FIG. 7 is enlarged schematic representation of the balling and bridging phenomenon of FIG. 6.
Figure 8:
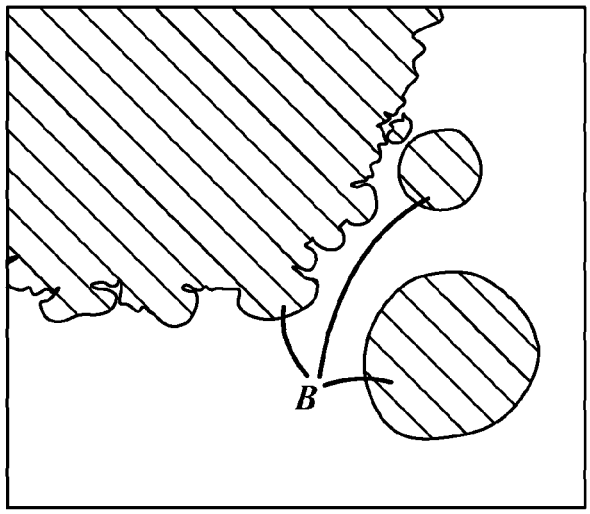
FIG. 8 is a cross-sectional schematic representation of the balling and bridging phenomenon of FIG. 7.

As discussed, precious metal alloys like platinum (Pt) based alloys have been used for spark plug electrodes. Platinum-based alloys exhibit a certain degree of oxidation, corrosion, and erosion resistance that is desirable in certain applications including in use in an internal combustion engine. But not all Pt-based alloys are as effective as desired. Referring to FIGS. 6-8, for example, it has been discovered that Pt alloys like a Pt4W alloy experience a so-called balling and bridging phenomenon in which locally excessive oxidation and re-deposition of material creates Pt balls B at a surface thereof. If this occurs, it does so during high temperature operation in an internal combustion engine, and over time the Pt balls B can collect and form a bridge across the spark gap G. When formed, the Pt balls B contribute to erosion and corrosion of the spark plug electrodes and negatively affect the spark performance of the spark plug. It has been found that the electrode materials described below limit or altogether prevents this balling and bridging phenomenon, while maintaining suitable characteristics such as ductility for forming different shapes of spark plug electrodes. The electrode material may be composed of a high temperature performance alloy, such as the Pt-based alloy described herein. In different embodiments, the electrode material or Pt-based alloy can include aluminum (Al), one or more refractory metals selected from a certain group, and titanium (Ti), chromium (Cr), or a combination of both Ti and Cr.

As its name suggests, the Pt-based alloy includes a balance substantially of Pt. The amount of Pt influences the strength of the alloy including its resistance to oxidation, corrosion, and erosion. In one embodiment, the alloy includes Pt in an amount of at least about 50.0 atomic %, or in amount of about 50 to 99 atomic %. The atomic % of Pt is determined by dividing the number of Pt atoms per unit volume of the entire Pt-based alloy by the number of atoms of the entire Pt-based alloy per unit volume of the entire Pt-based alloy. In another embodiment, the alloy includes Pt in an amount of at least about 55.0 atomic %. In another embodiment, the alloy includes Pt in an amount of at least about 65.0 atomic %. In yet another embodiment, the alloy includes Pt in an amount of at least about 79.0 atomic %. In another embodiment, the alloy includes Pt in an amount of about 50% to about 95.0 atomic %. In yet another embodiment, the alloy includes Pt in an amount less than about 95.0 atomic %. In another embodiment, the alloy includes Pt in an amount less than about 94.0 atomic %. And in another embodiment, the alloy includes Pt in an amount less than about 84.0 atomic %. The presence and amount of the Pt may be detected by performing a chemical analysis on a section or surface of the electrode material, or by generating and viewing an energy-dispersive spectroscopy (E.D.S.) of a section or surface of the electrode material with an scanning electron microscopy (S.E.M.) instrument.

The Pt-based alloy comprises Al in an amount that influences the oxidation resistance of the alloy. For example, as will be described below, Al may contribute to the formation of an aluminum oxide ($Al_2O_3$) layer on the electrodes of the spark plug that helps shield and protect the underlying alloy from excessive and unwanted oxidation. In certain amounts, the Al may also strengthen the alloy in terms of its resistance to corrosion and erosion. In one embodiment, the Pt-based alloy comprises Al in an amount of about 5.0 atomic % to about 20.0 atomic %. The atomic % of Al is determined by dividing the number of Al atoms per unit volume of the entire Pt-based alloy by the number of atoms of the entire Pt-based alloy per unit volume of the entire Pt-based alloy. In another embodiment, the Pt-based alloy includes Al in an amount of at least about 5.0 atomic %. In another embodiment, the Pt-based alloy includes Al in an amount of at least about 10.0 atomic %. In yet another embodiment, the Pt-based alloy includes Al in an amount of at least about 16.0%. In another embodiment the Pt-based alloy includes Al in an amount less than about 20.0 atomic %. In yet another embodiment, the Pt-based alloy includes Al in an amount less than about 14.0 atomic %. In another embodiment, the Pt-based alloy includes Al in an amount less than about 10.0 atomic %. In yet another embodiment, the Pt-based alloy includes Al in an amount less than about 6.0 atomic %. The presence and amount of Al in the Pt-based alloy may be detected by a chemical analysis, or by viewing an E.D.S. of the electrode material. The E.D.S. may be generated by a S.E.M. instrument.

At high temperatures, each electrode or firing tip comprising the Pt-based alloy with Al forms an aluminum oxide ($Al_2O_3$) layer at its outer surface, including the sparking surfaces of the firing tips, for example. The $Al_2O_3$ layer is typically formed when the Pt-based alloy is heated to a temperature greater than about 500 or 600° C., such as during use of the spark plug in an internal combustion engine. When the sparking surfaces comprise a planar surface, the $Al_2O_3$ layer typically extends along the planar surface. Thus, the electrodes or firing tips may comprise a gradient material composition, wherein the sparking surface includes a layer of $Al_2O_3$ and the adjacent portion or bulk of the firing tip comprises another composition including the Al and Pt, for example. Prior to exposing the Pt-based alloy to high temperatures, the $Al_2O_3$ layer is not present, and the firing tips typically comprise a uniform material composition that otherwise does not include an aluminum oxide ($Al_2O_3$) material. Once the $Al_2O_3$ layer forms at the outer surface or sparking surface, it typically remains there at all temperatures. Such an $Al_2O_3$ layer is dense, stable, and has low formation free energy. Thus, the $Al_2O_3$ layer may provide improved oxidation resistance to protect the firing tips from erosion and corrosion when the spark plug electrodes are exposed to spark and the extreme conditions of the combustion chamber, and helps limit or altogether prevent the balling and bridging phenomenon described above.

The amount of Al can influence the oxidation performance of the Pt-based alloy by partly dictating the presence and thickness of the $Al_2O_3$ layer that is formed. For example, the Pt-based alloy can have at least about 5.0 atomic % Al to form the $Al_2O_3$ layer; in other examples, the $Al_2O_3$ layer can be formed with less than 5.0 atomic % Al. And when the Al is present in an amount of about 5.0 atomic % to about 20.0 atomic %, the $Al_2O_3$ layer formed at the sparking surface has a predetermined thickness depending on the exact percentage, which in some cases provides a sufficient discharge voltage and ablation volume per spark during use of the spark plug in an internal combustion engine. The predetermined thickness can vary depending on the specific composition of the Pt-based alloy and conditions of the combustion chamber. In one example, the predetermined thickness is about 0.10 microns (μm) to about 10.0 microns (μm). In one example, if the Pt-based alloy includes greater than about 20.0 atomic % Al, the $Al_2O_3$ layer has an excessive thickness, which can lead to an increased and in some cases undesirable discharge voltage and ablation volume per spark during operation of the spark plug in an internal combustion engine; in other examples, having greater than 20.0 atomic % Al is possible and does not undesirably affect the spark plug in the ways described. The presence and thickness of the $Al_2O_3$ layer can be detected by heating the sparking surface to a temperature greater than about 500 or 600° C., and performing a chemical analysis on the sparking surface, or by generating and viewing an E.D.S. of the sparking surface with an S.E.M. instrument.

Depending on the Al percentage and the temperature of the electrode material, the Pt-based alloy may include a $Pt_3Al$ phase and its associated $Pt_3Al$ precipitate as depicted in a binary phase diagram of the elements Pt and Al versus temperature. For example, when the Pt-based alloy includes Al in an amount less than about 10.0 atomic % of the alloy, the microstructure may consist of a single-phase Pt solid solution at all temperatures and may not include the $Pt_3Al$ phase. But in another example where the Pt-based alloy includes Al in an amount more than 10.0. atomic %, the alloy can include a multi- or two-phase microstructure with a $Pt_3Al$ phase. The first phase is the Pt solid solution phase, and the second phase is the $Pt_3Al$ phase having a comparatively higher-strength crystal structure. The $Pt_3Al$ phase of the alloy is dissolved in the Pt matrix of the alloy at high temperatures, such as during sintering, arc melting, or other high temperature metallurgy processes used to form the alloy. But at lower temperatures, such as when the spark plug is not in use, the $Pt_3Al$ phase precipitates out of the Pt matrix of alloy and transitions to a $Pt_3Al$ precipitate. The temperature at which the $Pt_3Al$ phase precipitates out may depend on, among other factors, the specific composition of the alloy. The $Pt_3Al$ precipitate will dissolve back into the alloy when the temperature of the alloy increases its non-use temperature to higher temperatures, such as when the spark plug is put in use in an internal combustion engine at elevated operating temperatures of 500 or 600° C. The presence and amount of the $Pt_3Al$ precipitate and phase may be detected by performing a chemical analysis on a surface or section of the electrode material, or by generating and viewing an E.D.S. of a surface or section of the electrode material with an S.E.M. instrument.

The Pt-based alloy may also include one or more refractory metals or elements, selected from a specified group, in an amount that influences the strength of the alloy. For example, the relatively high melting points of the refractory metals may provide the Pt-based alloy with a high resistance to spark erosion or wear, though need not. The refractory metals may also add strength to the Pt solid solution phase to the extent present in the electrode material. The specified group of refractory metals includes one or more of nickel (Ni), ruthenium (Ru), rhenium (Re), tantalum (Ta), molybdenum (Mo), and tungsten (W). In other words, the Pt-based alloy may include only a single one of the refractory metals or a combination of more than one refractory metal. In one embodiment, the refractory metal—whether provided singly or in combination—is present in an amount of less than about 30.0 atomic % of the alloy; that is, a single refractory metal can add up to 30.0 atomic %, or a first refractory metal at 15 atomic % and a second refractory metal at 15 atomic % can be added together to get the 30.0 atomic %. The atomic % of refractory metal is determined by dividing the number of refractory metal atoms per unit volume of the entire Pt-based alloy by the number of atoms of the entire Pt-based alloy per unit volume of the entire Pt-based alloy.

When added, the refractory metal may replace a portion or more of the Pt or Al, which reduces the overall cost of the Pt-based alloy. In some embodiments, the total amount of the refractory metal may be kept below about 30.0 atomic % in order to prevent the precipitation of, and transition to, a brittle intermetallic phase in the particular Pt-based alloy, which may be harmful to the alloy or otherwise may hinder the performance of the alloy; of course, in other embodiments this may be less of a concern and the refractory metal can be provided in an amount greater than 30.0 atomic %. In another embodiment, the Pt-based alloy includes a refractory metal in an amount less than about 20.0 atomic %. In another embodiment, the Pt-based alloy includes a refractory metal in an amount less than about 14.0 atomic %. In yet another embodiment, the Pt-based alloy includes a refractory metal in an amount less than about 10.0 atomic %. In another embodiment, the Pt-based alloy includes a refractory metal in an amount less than about 4.0 atomic %. In another embodiment, the Pt-based alloy includes a refractory metal in an amount of at least about 0.01 atomic %. In yet another embodiment, the Pt-based alloy includes a refractory metal in an amount of at least about 0.1 atomic %. In another embodiment, the Pt-based alloy includes a refractory metal in an amount of at least about 3.0%. And in yet another embodiment, the Pt-based alloy includes a refractory metal in an amount of at least about 10.0 atomic %. The presence and amount of refractory metal may be detected by performing a chemical analysis on a section or surface of the electrode material, or by generating and viewing an E.D.S. of a section or surface of the electrode material with an S.E.M. instrument.

The Pt-based alloy may also include titanium (Ti), chromium (Cr), or a combination of both Ti and Cr, in an amount that influences the alloy's oxidation resistance and/or its stabilization of certain chemical phases such as the $Pt_3Al$ phase described. For example, when present, the Ti and/or Cr elements increase the oxidation resistance of the Pt-based alloy and can promote stabilization of the $Pt_3Al$ phase at high temperatures to thus improve the microstructure of the Pt-based alloy. The exact amount of Ti and/or Cr in the alloy can be dictated by the amount of Al. For example, when Al is present in an amount of about 20.0 atomic %, it may be beneficial to include a greater amount of Ti and/or Cr as compared to an alloy with only 5.0 atomic % Al present. The atomic % of Ti and/or Cr is determined by dividing the number of Ti and/or Cr atoms per unit volume of the entire Pt-based alloy by the number of atoms of the entire Pt-based alloy per unit volume of the entire Pt-based alloy.

In one embodiment, the Pt-based alloy includes Ti and/or Cr in an amount less than about 10.0 atomic %. In another embodiment, the Pt-based alloy includes Ti and/or Cr in an amount less than about 5.5 atomic %. In yet another embodiment, the Pt-based alloy includes Ti and/or Cr in an amount less than about 2.0 atomic %. In another embodiment, the Pt-based alloy includes Ti and/or Cr in an amount of at least about 0.01 atomic %. In yet another embodiment, the Pt-based alloy includes Ti and/or Cr in an amount of at least about 0.1 atomic %. In another embodiment, the Pt-based alloy includes Ti and/or Cr in an amount of at least about 1.5 atomic %. The presence and amount of the Ti and/or Cr may be detected by performing a chemical analysis on a section or surface of the electrode material, or by generating and viewing an E.D.S. of a section or surface of the electrode material with an S.E.M. instrument.

Examples of suitable Pt-based alloys and electrode material compositions include those compositions having 10 atomic % aluminum (Al) and 4 atomic % of one or more of the refractory metals selected from the group consisting of nickel (Ni), rhenium (Re), ruthenium (Ru), tantalum (Ta), molybdenum (Mo), and tungsten (W). Such compositions may include the following non-limiting examples: Pt-10Al-4Ru and Pt-10Al-4W; other examples are certainly possible.

The electrode material can be made using known powder metal processes that include choosing powder sizes for one or more of the metals, blending the powders to form a powder mixture, compressing the powder mixture under high isostatic pressure and/or high temperature to a desired shape, and sintering the compressed powder to form the electrode material. This process can be used to form the material into shapes (such as rods, wires, sheets, etc.) suitable for further spark plug electrode and/or firing tip manufacturing processes. Other known techniques such as arc melting, sintering, and/or blending the desired amounts of each constituent can also be used. In addition, melting using induction heat or other types of heat sources can be used to melt powder of other solid forms of one or more of the electrode material elements. In some cases, the electrode material can be further processed using conventional cutting, grinding, and extruding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode, or both includes an electrode material having about 50 to 99 atomic %, inclusive, of platinum (Pt), having about 5 to 10 atomic %, inclusive, of aluminum (Al), and having no more than about 30 atomic % of a refractory metal selected from the group consisting of: nickel (Ni), rhenium (Re), ruthenium (Ru), tantalum (Ta), tungsten (W), molybdenum (Mo), or a combination thereof, wherein the electrode material limits locally excessive oxidation and re-deposition of platinum (Pt) at a surface of the electrode material.

2. The spark plug of claim 1, wherein the electrode material forms an aluminum oxide ($Al_2O_3$) layer at a temperature of more than about 500° C. and the aluminum oxide layer is formed on an outer surface of the center electrode, the ground electrode, or both.

3. The spark plug of claim 2, wherein the aluminum oxide layer has a thickness of about 0.10 to 10.0 microns (μm).

4. The spark plug of claim 1, wherein the electrode material is a single-phase platinum (Pt) solid solution.

5. The spark plug of claim 1, wherein the electrode material has about 10 to 20 atomic % of aluminum (Al), and the electrode material is a multi-phase platinum-based alloy with a $Pt_3Al$ precipitate.

6. The spark plug of claim 5, wherein the electrode material further has no more than about 10 atomic % of titanium (Ti), chromium (Cr), or a combination thereof.

7. The spark plug of claim 1, wherein the electrode material has about 10 atomic % of aluminum (Al), and has about 4 atomic % of the refractory metal selected from the group consisting of: nickel (Ni), rhenium (Re), ruthenium (Ru), tantalum (Ta), tungsten (W), molybdenum (Mo), or a combination thereof.

8. The spark plug of claim 1, wherein the electrode material has about 10 atomic % of aluminum (Al), and has about 4 atomic % of the refractory metal ruthenium (Ru).

9. The spark plug of claim 1, wherein the electrode material has about 10 atomic % of aluminum (Al), and has about 4 atomic % of the refractory metal tungsten (W).

10. The spark plug of claim 1, wherein the center electrode, the ground electrode, or both includes an attached firing tip that is at least partially made from the electrode material.

11. The spark plug of claim 10, wherein the firing tip is a multi-piece rivet that includes a second component attached to the center electrode or the ground electrode, and a first component that is attached to the second component and is at least partially made from the electrode material.

12. The spark plug of claim 1, wherein the center electrode, the ground electrode, or both is at least partially made from the electrode material and does not include an attached firing tip.

13. A spark plug electrode, comprising:

an electrode material having about 50 to 99 atomic % of platinum (Pt), having about 5 to 20 atomic % of aluminum (Al), having no more than about 30 atomic % of a refractory metal selected from the group consisting of: nickel (Ni), rhenium (Re), ruthenium (Ru), tantalum (Ta), tungsten (W), molybdenum (Mo), or a combination thereof, and having no more than about 10 atomic % of titanium (Ti), chromium (Cr), or a combination thereof.

14. The spark plug electrode of claim 13, wherein the electrode material forms an aluminum oxide ($Al_2O_3$) layer at a temperature of more than about 500° C. and the aluminum oxide layer is formed on an outer surface of the center electrode, the ground electrode, or both.

15. The spark plug electrode of claim 13, wherein the electrode material has about 5 to 10 atomic % of aluminum (Al), and the electrode material is a single-phase platinum (Pt) solid solution.

16. The spark plug electrode of claim 13, wherein the electrode material has about 10 to 20 atomic % of aluminum (Al), and the electrode material is a multi-phase platinum-based alloy with a $Pt_3Al$ precipitate.

17. The spark plug electrode of claim 13, wherein the electrode material has about 10 atomic % of aluminum (Al), and has about 4 atomic % of the refractory metal selected from the group consisting of: nickel (Ni), rhenium (Re), ruthenium (Ru), tantalum (Ta), tungsten (W), molybdenum (Mo), or a combination thereof.

18. The spark plug electrode of claim 13, wherein the electrode material has about 10 atomic % of aluminum (Al), and has about 4 atomic % of the refractory metal ruthenium (Ru).

19. The spark plug electrode of claim 13, wherein the electrode material has about 10 atomic % of aluminum (Al), and has about 4 atomic % of the refractory metal tungsten (W).

* * * * *